US007677793B2

(12) United States Patent
Lete et al.

(10) Patent No.: US 7,677,793 B2
(45) Date of Patent: Mar. 16, 2010

(54) TIMEPIECE

(75) Inventors: Patrick Lete, Le Valdahon (FR); Laurent Besse, Villers-le-Lac (FR)

(73) Assignee: Les Artisans Horlogers Sarl, Le Locle (CH)

( * ) Notice: Subject to any disclaimer, the term of this patent is extended or adjusted under 35 U.S.C. 154(b) by 0 days.

(21) Appl. No.: 11/995,201

(22) PCT Filed: Jul. 13, 2006

(86) PCT No.: PCT/EP2006/064176

§ 371 (c)(1),
(2), (4) Date: Jan. 10, 2008

(87) PCT Pub. No.: WO2007/006805

PCT Pub. Date: Jan. 18, 2007

(65) Prior Publication Data

US 2008/0198701 A1 Aug. 21, 2008

(30) Foreign Application Priority Data

Jul. 13, 2005 (EP) ..... 05106388

(51) Int. Cl.
*G04B 15/00* (2006.01)
*G04B 1/10* (2006.01)

(52) U.S. Cl. ..... 368/127; 368/142

(58) Field of Classification Search ..... 368/124–127, 368/140, 142

See application file for complete search history.

(56) References Cited

U.S. PATENT DOCUMENTS

| | | | | |
|---|---|---|---|---|
| 7,004,619 | B2 * | 2/2006 | Papi | 368/127 |
| 7,160,026 | B2 * | 1/2007 | Golay | 368/127 |
| 7,445,375 | B2 * | 11/2008 | Kasapi | 368/127 |

FOREIGN PATENT DOCUMENTS

| | | | |
|---|---|---|---|
| EP | 1 465 024 | A1 | 10/2004 |
| EP | 1 615 085 | A1 | 1/2006 |
| SU | 958048 | | 1/1979 |
| WO | WO 2007/033513 | A2 * | 3/2007 |
| WO | WO 2005/043257 | A1 * | 5/2007 |

OTHER PUBLICATIONS

Reymondin et al., "Theorie de l'horlogerie," Federation des Ecoles Tech., pp. 99-169 (1998).

* cited by examiner

*Primary Examiner*—Vit W Miska
*Assistant Examiner*—Sean Kayes
(74) *Attorney, Agent, or Firm*—Young & Thompson

(57) ABSTRACT

In order to counter the effects of the Earth's gravitational force on the operation of a watch movement, the timepiece includes an escapement mechanism designed to drive a finish gear-train of a watch movement which defines a reference plane, and a balance co-operating with the escapement mechanism. Particularly, the balance is mounted in a frame (28, 60), said frame pivoting about a first axis (AA, CC) relative to the reference plane, and the orientation of the frame (28, 60) relative to the first axis (AA, CC) depends on the orientation of the Earth's gravitational force.

13 Claims, 5 Drawing Sheets

TIMEPIECE

BACKGROUND OF THE INVENTION

1) Field of the Invention

The present invention relates to the field of mechanical horology. It more particularly concerns a timepiece provided with a particular regulator organ.

2) Description of Related Art

In some mechanical timepieces, in particular in bracelet watches, the motor organ which makes it possible to transmit energy to the movement is a spring housed in a drum to form a barrel. Unwinding of the barrel is controlled by a distributor organ called an escapement which also aims to maintain and count the oscillations of the regulator organ formed by a balance connected to a spiral-coiled spring.

Other details on escapements and regulation organs can be found in the book "Théorie de l'horlogerie" by Reymondin et al, Fédération des Ecoles Techniques, 1998, ISBN 2-940025-10-X, pages 99 to 169.

One knows that, when the escapement of a mechanical watch is in the vertical position, the inevitable imbalances of the balance and the spiral caused by the Earth's gravity cause operating variations. This is why the operation of a watch must be checked in different positions.

To resolve this drawback, a device known by the name tourbillon was developed by Breguet. The tourbillon, which constitutes a renowned complication in mechanical horology, is currently very widely used. Its purpose is to compensate for variations due to gravity by causing the spring balance, in the case of a single-axis tourbillon, to go through all vertical positions.

However, the construction of a tourbillon is extremely complex. Moreover, a device of this type derives all of its purpose from pocket watches and miniature clocks, which are nearly always in a vertical position. But its usefulness is more doubtful in a bracelet watch, which is likely to occupy all positions and is almost never in a completely vertical position.

Moreover, in the great age of maritime travel (late XVIIth century), marine chronometers were developed to provide instruments making it possible to measure time with great precision, despite pitching and rolling. The case containing the clockwork movement is, in a manner of speaking, suspended. More specifically, it is mounted on a support, a system of gimbals enabling the support to orient itself in all three spatial dimensions. The support is coupled to a counterpoise. Thus, despite the movements of the swell, the gravity undergone by the counterpoise combined with the action of the gimbals, keeps the support horizontal relative to a terrestrial reference.

This type of gimbal system cannot be transposed to the inside of a movement for a portable timepiece, as it is too bulky. Moreover, the problem of the connection between the going train and the part suspended by the gimbal remains unsolvable to date.

The present invention aims to propose a timepiece whereof the operation of the regulator organ is not exposed to variations in gravity and does not present the aforementioned drawbacks.

SUMMARY OF THE INVENTION

More precisely, the invention concerns a timepiece comprising an escapement mechanism receiving energy from an energy source of a watch movement, said movement defining a first reference plane, and a balance cooperating with said escapement mechanism. The balance is mounted in a frame pivoting around a first axis relative to the first reference plane. According to the invention, the orientation of the frame relative to the first axis depends on the orientation of the Earth's gravitational force.

BRIEF DESCRIPTION OF THE DRAWINGS

Other details will appear more clearly upon reading the following description, done in reference to the appended drawing in which.

EMBODIMENT(S) OF THE INVENTION

Figure 1:
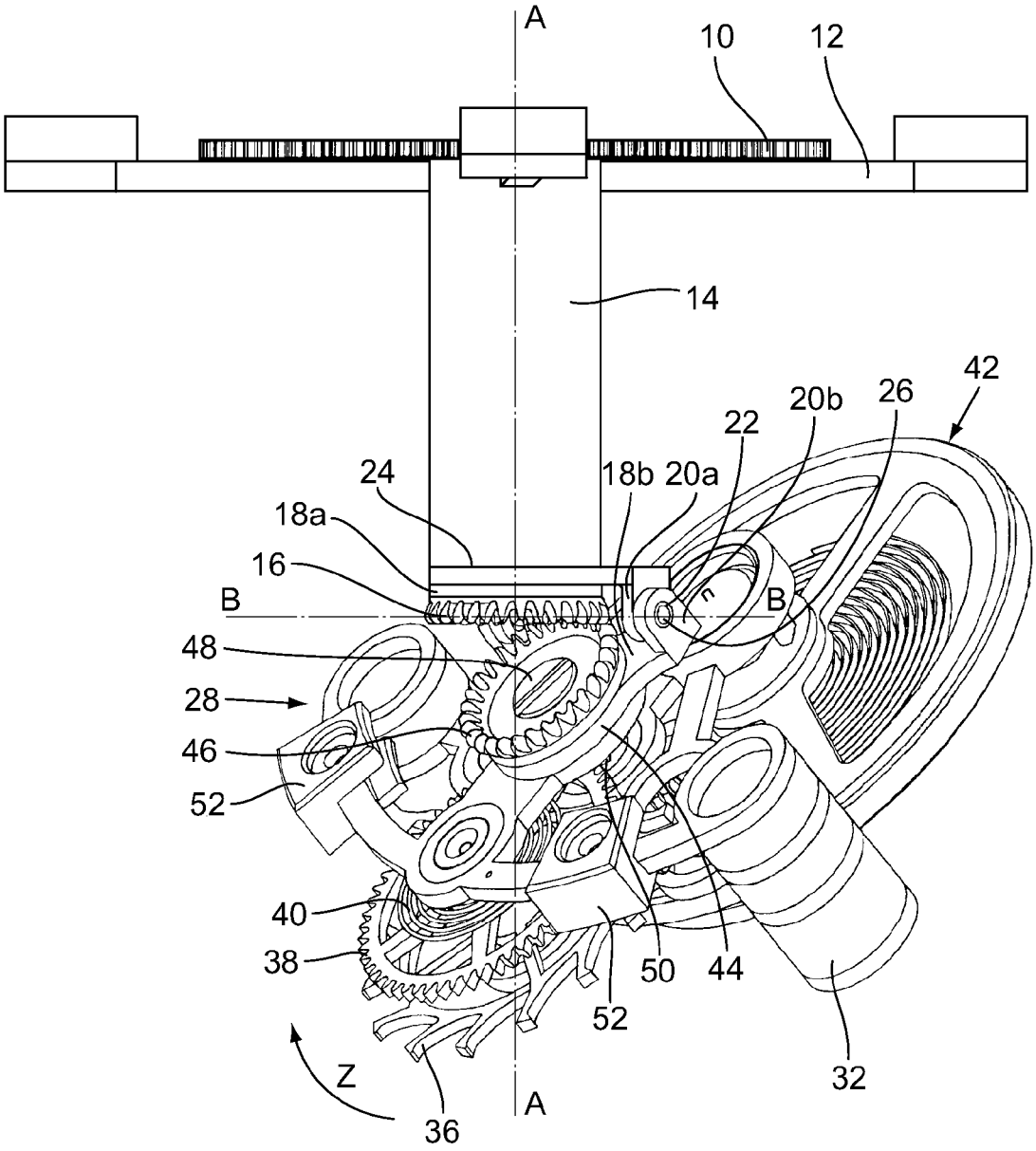
FIG. 1 is a perspective view of the device according to the invention.

FIG. 1 shows a second wheel 10 of the going train of a watch movement which defines a first reference plane. A support structure 12 designed, as one sees in FIG. 4, to be fixed to the plate which supports the movement, is arranged near the wheel 10, parallel to said wheel. In the example, the support 12 is made using three arms, better visible in FIG. 2, which intersect on an axis orthogonal to the wheel 10 and going through its center.

The wheel 10 drives an arbor 14 in rotation, the arbor being oriented perpendicular to said wheel. Advantageously, said arbor 14 is integral with the wheel 10 at a first of its ends. At its other end, it ends with a first conical toothed pinion 16, which is also integral therewith. The arbor defines an axis AA.

A connecting organ is mounted at the end of the arbor 14, on the side where the pinion 16 is located. It is made up of two washer-shaped elements 18*a* and 18*b*, advantageously of similar dimensions, each provided with two lugs 20*a* and 20*b* oriented orthogonally relative to the washers and pierced with a hole 22*a* and 22*b*. The first washer 18*a* is mounted in a groove 24 arranged on the arbor 14 in which it can slide, around the axis AA. Preferably, the groove is positioned in a plane orthogonal to AA.

The second washer 18*b* is arranged opposite the first 18*a*. The holes 22*a* and 22*b* of the lugs 20*a* and 20*b* of both washers are aligned along an axis BB and form joints with balance-spring studs 26 which go through them. Thus, the second washer 18*b* is mobile in rotation along the axes AA and BB relative to the arbor 14.

A spring balance and a watch movement assortment, comprising the pans of the balance, a pallet and an escapement wheel, are arranged in a frame 28, made up of two bridges connected by pillars 32. The escapement is of the constant force type. This type of mechanism is particularly well-known by those skilled in the art and does not need to be described in detail here.

As an example, the figures illustrate a distributor organ made up of a pallet escapement. This pallet escapement primarily comprises a pallet 34 which periodically retains an escapement wheel 36. Said escapement wheel 36 is integral with an escapement pinion 38 supporting an auxiliary spiral-coiled spring 40 which fulfills the "constant force" role of the escapement. Traditionally, the pallet cooperates with a spring balance 42.

More particularly, the frame 28 comprises, in an area located between the axis of the escapement wheel 36 and that of the spring balance 42, an annular portion 44 provided with a hole.

The frame 28 is mounted integral on the washer 18*b* such that the hole 22*b* is aligned with the hole of the portion 44. For example, the annular portion 44 is welded to the washer 18*b*. In one advantageous variation, the washer 18*b* is integral with the bridge and ends with the two lugs 20*b*.

A second conical toothed pinion 46 is pivotably mounted on the hole of the second washer 18*b* and on that of the portion 44. It is provided with an arbor 48 which goes through the washer 18*b* and the annular portion 44, and ends with a pinion 50, whereof only one tooth is visible in the drawing, which engages with the escapement pinion 38.

Thus, the regulator organ is kinematically connected to a barrel comprised by the watch movement, through the second wheel 10, the arbor 14 and the set of pinions 16, 46 and 50. The escapement receives the energy dispensed at the base by the barrel and periodically allows a portion of this driving power to escape to restore the power lost through friction to the regulator organ.

Figure 2:
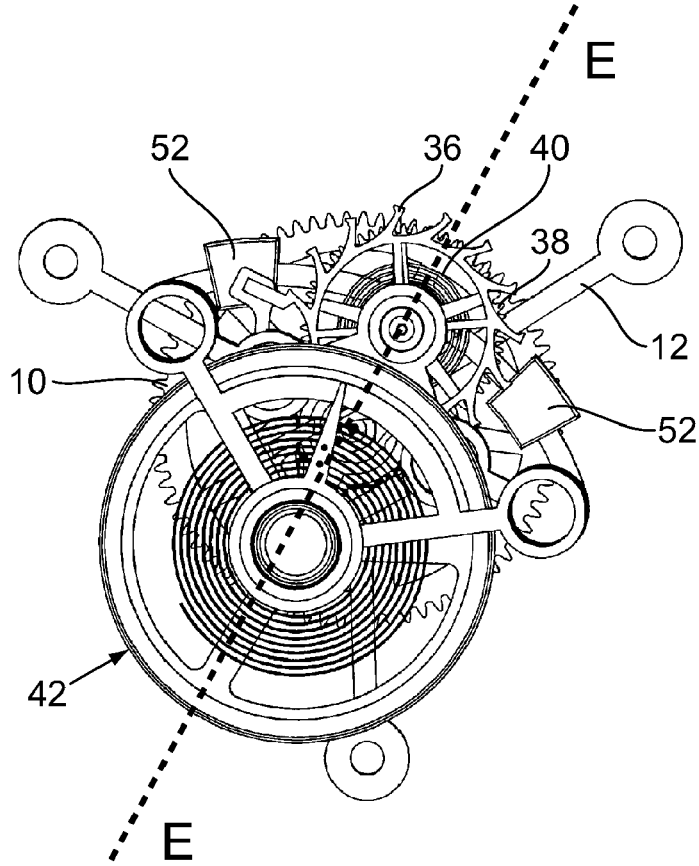
FIGS. 2 and 3 are top and side views of the device in a first position.
Figure 3:
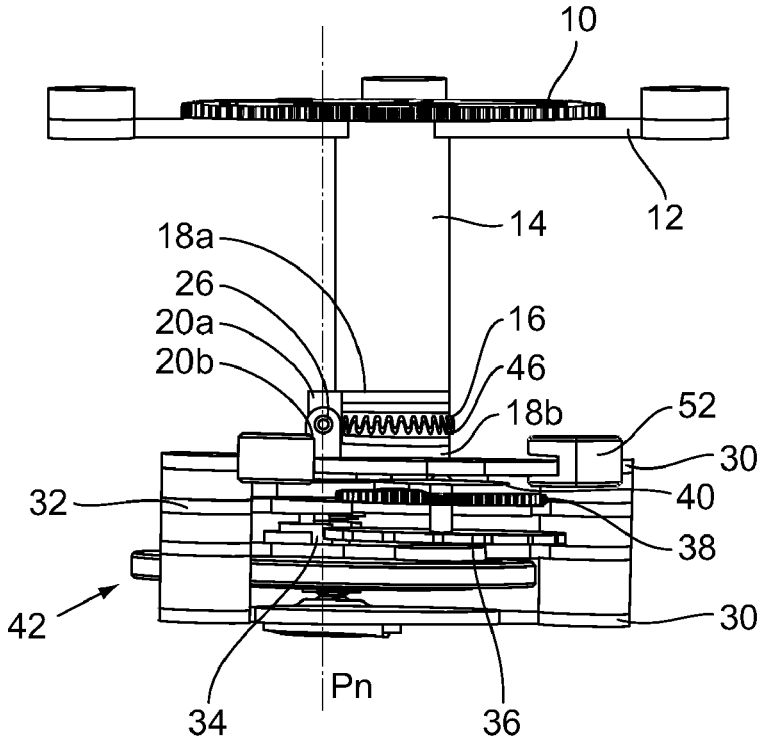

When the watch is horizontal, the device is as shown in FIGS. 2 and 3, i.e. the conical pinions 16 and 46 engage with each other completely.

The center of gravity of the frame supporting the regulator organ must be located in a plane going through the axis BB and oriented along the direction of the Earth's gravitational force, i.e., when the watch is horizontal, in a plane orthogonal relative to the going train. This plane constitutes a second reference plane called Pr.

The purpose of the device is to allow the frame 18, when the wearer of the watch moves, to move such that the regulator organ remains in the horizontal position relative to a terrestrial reference.

If the center of gravity of the assembly formed by the frame, the assortment and the spring balance moves from the side of the reference plane which does not comprise the arbor 14, the frame pivots around the axis BB such that the center of gravity remains in the reference plane Pr.

If the center of gravity moves from the side of the reference plane which does comprise the arbor 14, the two conical toothed pinions bear on each other. If the center of gravity remains in a plane orthogonal to the reference plane containing the center of the first washer 18*a*, the device is then in a metastable position in which the regulator organ cannot be horizontal. However, in real conditions, a slight imbalance of the frame relative to this metastable position makes it possible to obtain a first pivoting through rotation of the frame around the axis AA by rotating the first washer 18*a* on the groove 24. The center of gravity then goes back to the other side of the reference plane Pr and, as in the description above, the frame pivots around the axis BB such that the center of gravity remains in the second reference plane. In reality, the two pivotings around the axes AA and BB take place simultaneously and combine with each other.

To promote and improve the reactivity of the system so that the frame 28 is able to move when the watch is moved, the latter supports weights 52, arranged in particular at the level most removed from the axes of rotation. In the figures, the weights are shown near the escapement wheel 36.

Advantageously, they can slide on the frame 28 to facilitate adjustment of the device.

Figure 4:
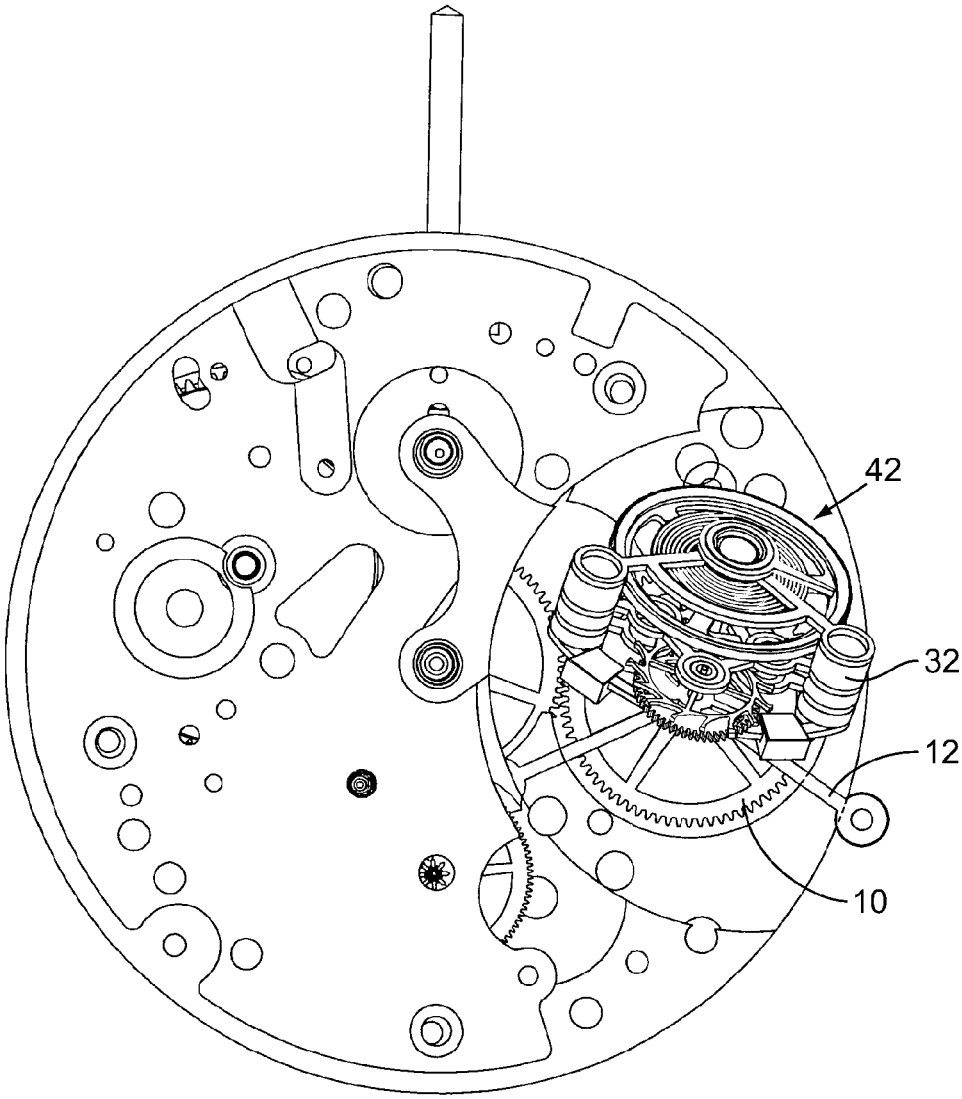
FIG. 4 shows the integration of the device into a watch movement.

Moreover, one understands that, for the assortment, the spring balance and the frame 28 to be able to move freely, the height between the support structure 12 and the axis BB must be greater than the largest dimension orthogonal to the reference plane Pr of the parts of the assortment, balance or frame located on the side of the reference plane not comprising the arbor 14. In the illustrated example, this maximal dimension is defined by the distance between the spring balance 42 and the reference plane. As shown in FIG. 4, the movement in which the device according to the invention is integrated must not comprise elements which may hinder the movement of the frame 28, the assortment and the spring balance.

One will note that the axes of the escapement wheel 36 and pinion 38, the conical toothed pinions 16 and 46 and the spring balance 42 are aligned, as shown by the axis EE of FIG. 2. Likewise, when the watch is horizontal, the second wheel 10, arbor 14, conical pinions 16 and 46, washers 18 and pinion 50 are centered on the axis AA.

The coefficient of friction between the first washer 18*a* and the arbor 14 must be greater than the friction of the assortment, thereby ensuring that the escapement pinion 36 indeed transmits its energy to the going train and does not cause the frame 28 to rotate around the arbor 14.

In operation, the escapement wheel pivots in the direction indicated by the arrow Z in FIG. 1. The pinion 50 therefore turns in the opposite direction. When, because of movement of the watch, the frame 28 pivots in the direction opposite that shown by the arrow Z around the axis AA, the escapement wheel 36 loses time relative to its normal movement. The auxiliary spring 40 then stores energy and subsequently progressively releases it. When the frame pivots in the direction shown by the arrow Z, the escapement wheel 36 gains time relative to its normal movement. The auxiliary spring 40 relaxes and the barrel immediately unwinds more quickly so as to compensate for the decreased couple. In both cases, the auxiliary spring 40 acts as an intermediary such that the couple provided to the escapement wheel is constant.

Figure 5:
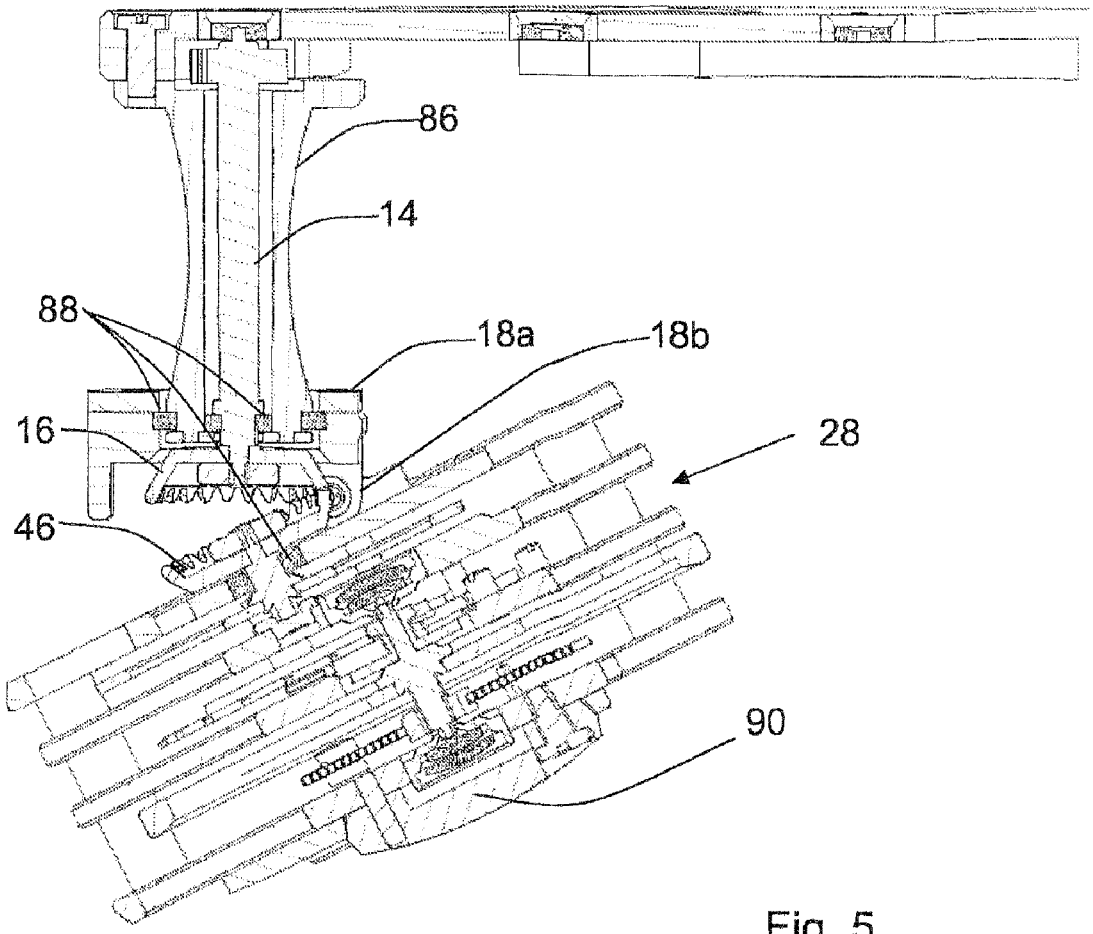
FIG. 5 is a cross-section of a variation having evolved from the first embodiment of the invention.

FIG. 5 shows a cross-section of a variation having evolved from the first embodiment according to the invention. The main differences relative to the device illustrated in FIGS. 1 to 4 are found in the arbor 14 pivotably mounted in a tube 86. One also distinguishes the jewels 88 which allow movement of the arbor relative to the tube and of the connecting organ relative to said tube, but also movement of the frame 28 relative to the connecting organ. The figure shows one example of an alternative to the washers for the elements of the connecting organ.

In this version, the frame does not support mobile weights, but is ballasted in the center of its lower part by an inertia block 90 arranged, for example, under the balance pivot.

Figure 6:
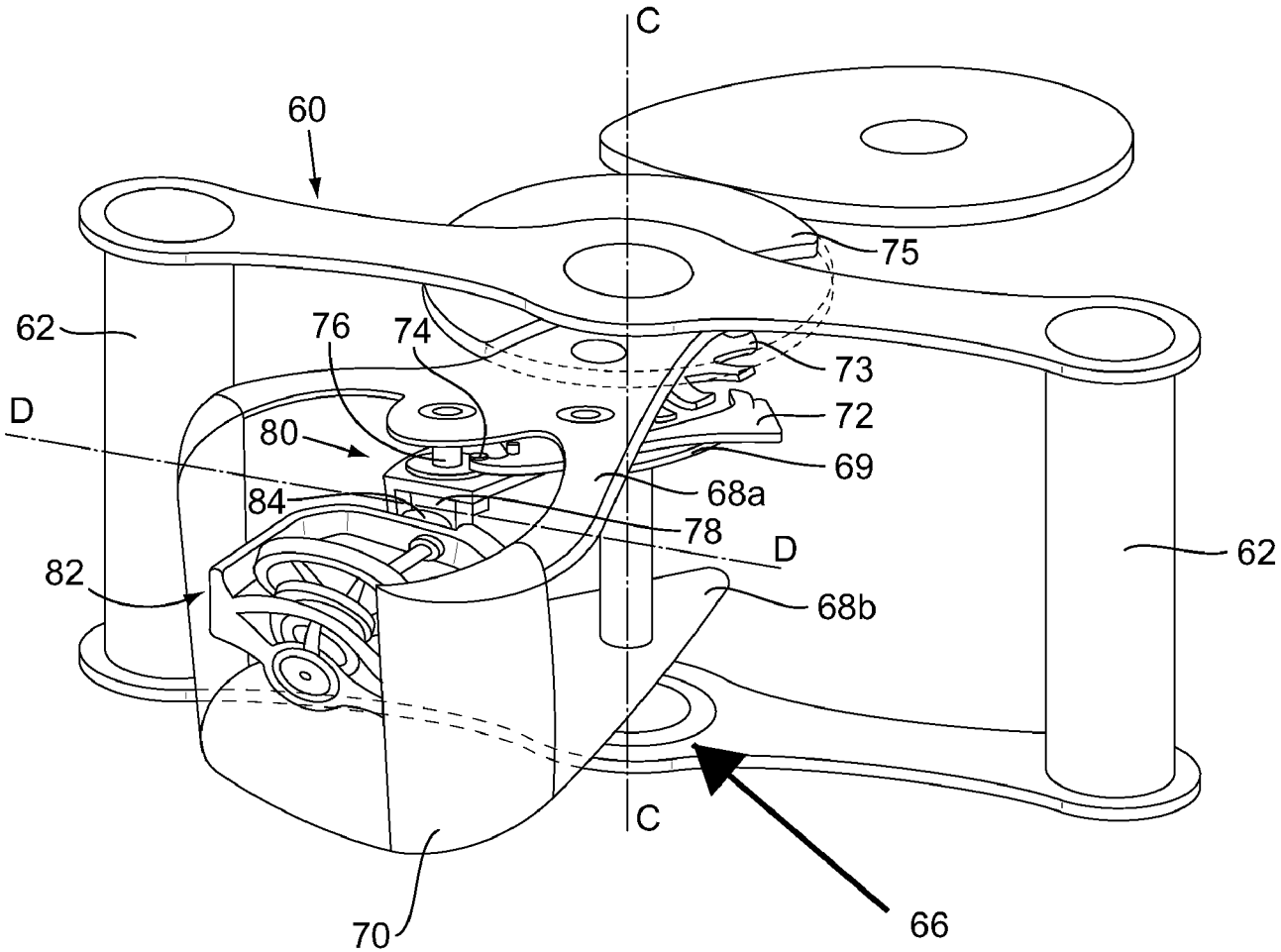
FIG. 6 illustrates another embodiment of the invention.

In another embodiment illustrated in FIG. 6, the assortment and spring balance assembly, also provided with a constant-force escapement, is mounted in a first frame 60 comprising, in the illustrated example, two pillars 62 and a central axis CC.

A second frame 66 formed primarily of two bridges 68*a* and 68*b* connected by pillars 70, is pivotably mounted around said central axis CC. The upper bridge 68*a* connected to an intermediate bridge 69, supports a pallet 72, while an escapement wheel 73 and an escapement pinion 75 connected to its auxiliary spring are mounted on the central axis. The pinion 75 is only partially illustrated, while the spring is not visible. Advantageously, the escapement pinion 75 is located between the first 60 and second 66 frames. In other words, the second frame is inserted between the escapement wheel 73 and pinion 75. In this way, the pinion 75 makes it possible to facilitate the kinematic link between the escapement and the going train, as it avoids hindering the rotation of the second frame 66 relative to the first.

The pallet 72 cooperates with an impulse-pin 74. The plate pivots between the upper bridge 68*a* and the intermediate bridge 69 and is provided with an arbor 76 which goes through the intermediate bridge 69 and ends with a conical toothed pinion 78. As described above, the arbor 76 comprises a connecting organ 80 comprising a joint having an axis DD which connects it in hinged manner to a third frame 82. One part of the elements forming the joint is integral or may be integral with the intermediate bridge 69. The spring balance is mounted in said third frame 82 and integrally drives, by an axis which goes through the frame 82, a second conical toothed pinion 84 which cooperates with the first 78.

Thus, the regulator organ is able to pivot around the axis DD, on one hand, but also, integrally with the assortment assembly, around the axis CC. The assembly of the second frame 66 pivots inside the first 60, whereof the pillars 62 are sufficiently distant from each other to allow a complete revolution of the second frame. To improve the reactivity of the assembly, the pillars 70 of the second frame are made of a heavy material.

Thus a timepiece is proposed whereof the regulator organ, alone or connected to the distributor organ, is arranged in a frame able to be oriented along two axes by the Earth's gravitational force. The plane of the spring balance remains approximately orthogonal to the direction of gravity. The operating variations generally observed in the various positions of the watch no longer exist.

In the embodiments which have just been described, the escapement illustrated is of the Swiss pallet type. One skilled in the art will easily be able to choose and adapt any type of escapement without going outside the scope of the invention. Likewise, one skilled in the art will be able to define and position bankings so as to avoid the frames assuming unfavorable extreme positions. The two conical toothed pinions connected to the connecting organ can be replaced, one by a spherical gear, and the other by a plate whereof the edges are curved in a convex direction, said edges having toothing which cooperates with the spherical toothing. A device of this type may be inspired by document SU 958048.

The mechanism according to the invention, like the Bréguet Tourbillon, seeks to limit the effects of the Earth's gravity on the regulator organ. In reference and homage to this prestigious predecessor, this mechanism is called Maelström.

The invention claimed is:

1. A timepiece comprising an escapement mechanism receiving energy from an energy source of a watch movement, said movement defining a first reference plane, and a balance cooperating with said escapement mechanism, said balance being mounted in a frame, said frame pivoting around a first axis relative to said first reference plane, wherein the orientation of said frame relative to said first axis depends on the orientation of the Earth's gravitational force.

2. The timepiece of claim 1, wherein said balance is mounted in a second frame, said balance and said escapement mechanism being connected by:

a connecting organ comprised by a first element pivoting on an arbor mobile in rotation relative to the second frame and a second element mounted in hinged manner on the first element using a joint defining a second axis, a first conical toothed pinion pivoting on said first element and driving said arbor, and a second conical toothed pinion pivoting on said second element, driven by said balance and cooperating with the first conical toothed pinion.

3. The timepiece of claim 1, wherein said frame pivots around a driving train designed to kinematically connect said escapement mechanism and the energy source, said driving train being driven in rotation around said first axis by said escapement mechanism.

4. The timepiece of claim 3, wherein said frame comprises weights whereof the position on the frame is adjustable.

5. The timepiece of claim 3, wherein said frame pivots around a second axis relative to said driving train, a second reference plane being defined by the plane parallel to the direction of the Earth's gravitational force and going through said second axis.

6. The timepiece of claim 5, wherein said frame comprises weights whereof the position on the frame is adjustable.

7. The timepiece of claim 5, wherein the center of gravity of the frame of the escapement and balance is located in the second reference plane.

8. The timepiece of claim 5, wherein said driving train is an arbor, and in that said arbor and said escapement mechanism are kinematically connected by:

a connecting organ which comprises a first element pivoting relative to said arbor and a second element mounted in hinged manner on the first element in reference to said second axis, a first conical toothed pinion pivoting relative to said first element and driving said arbor, and a second conical toothed pinion pivoting relative to said second element, kinematically connected to said escapement mechanism and cooperating with the first conical toothed pinion.

9. The timepiece of claim 8, wherein said frame comprises weights whereof the position on the frame is adjustable.

10. The timepiece of claim 8, wherein the length of the arbor between its end located on the side of the going train and said second axis is greater than the largest dimension orthogonal to the second reference plane of the escapement parts, the balance or the frame located on the side of the reference plane not comprising said arbor.

11. The timepiece of claim 8, wherein the escapement mechanism comprises an escapement wheel and pinion and wherein the axes of said escapement wheel (36) and pinion (38), the conical hed pin ions (16, 46) and the balance (42) are aligned along an axis EE.

12. The timepiece of claim 11, wherein said frame comprises weights whereof the position on the frame is adjustable.

13. The timepiece of claim 11, wherein the length of the arbor between its end located on the side of the going train and said second axis is greater than the largest dimension orthogonal to the second reference plane of the escapement parts, the balance or the frame located on the side of the reference plane not comprising said arbor.

* * * * *